US009058713B2

(12) United States Patent
Berube

(10) Patent No.: US 9,058,713 B2
(45) Date of Patent: Jun. 16, 2015

(54) INTERACTIVE INTERNET LOTTERY

(75) Inventor: Normand Berube, Lac-Beauport (CA)

(73) Assignee: LES DEVELOPPEMENTS AURIFOSSOR INC., Lac Beauport, Quebec (CA)

( * ) Notice: Subject to any disclaimer, the term of this patent is extended or adjusted under 35 U.S.C. 154(b) by 1560 days.

(21) Appl. No.: 11/589,083

(22) Filed: Oct. 30, 2006

(65) Prior Publication Data

US 2007/0218971 A1 Sep. 20, 2007

Related U.S. Application Data

(60) Provisional application No. 60/782,618, filed on Mar. 16, 2006.

(51) Int. Cl.
*A63F 9/24* (2006.01)
*G07F 17/32* (2006.01)

(52) U.S. Cl.
CPC ..... *G07F 17/32* (2013.01); *G07F 17/329* (2013.01)

(58) Field of Classification Search
CPC ..... G07F 17/329; G07F 17/32; G07F 17/42; A63F 3/0605; A63F 3/06; A63F 2003/088; A63F 3/061
USPC ..... 463/16–22, 30–40, 42
See application file for complete search history.

(56) References Cited

U.S. PATENT DOCUMENTS

| | | | |
|---|---|---|---|
| 4,692,863 | A | 9/1987 | Moosz |
| 4,795,161 | A | 1/1989 | Chao |
| 5,118,110 | A | 6/1992 | Jones |
| 5,628,684 | A | 5/1997 | Bouedec |
| 6,371,482 | B1 | 4/2002 | Hall, Jr. |
| 6,514,144 | B2 | 2/2003 | Riendeau et al. |
| 6,874,783 | B2 | 4/2005 | Higginson |
| 6,929,544 | B2 | 8/2005 | Osterer |
| 7,008,317 | B2 | 3/2006 | Cote et al. |
| 7,104,887 | B2 | 9/2006 | Hughes |
| 2002/0090986 | A1 | 7/2002 | Cote et al. |

(Continued)

FOREIGN PATENT DOCUMENTS

| | | |
|---|---|---|
| WO | WO 03/000365 | 1/2003 |

OTHER PUBLICATIONS

Computer and video games http://en.wikipedia.org/wiki/Interactive_game.

(Continued)

*Primary Examiner* — Steve Rowland
(74) *Attorney, Agent, or Firm* — Norton Rose Fulbright Canada LLP

(57) ABSTRACT

The invention relates to a method for generating a ticket to participate in a lottery draw. The ticket combination of elements is generated using an outcome of a computer-controlled interactive game, preferably a video game, played by at least one player. The elements of the ticket combination are selected among a list of predetermined elements, the predetermined elements corresponding to possible outcomes for the interactive game. The ticket combination may depend on the success of the player in the computer-controlled interactive game. Some of the participants may purchase a ticket bearing a ticket combination without using an outcome of the computer-controlled interactive game. Subsequently, the elements of a winning combination are randomly drawn among the list.

8 Claims, 12 Drawing Sheets

(56) References Cited

U.S. PATENT DOCUMENTS

| | | | | |
|---|---|---|---|---|
| 2002/0107073 | A1 | 8/2002 | Binney | |
| 2003/0045340 | A1 | 3/2003 | Roberts | |
| 2003/0060262 | A1 | 3/2003 | Yeend | |
| 2003/0162581 | A1 | 8/2003 | Dawson | |
| 2003/0199302 | A1* | 10/2003 | Weiss | 463/17 |
| 2004/0137980 | A1 | 7/2004 | Aenlle | |
| 2006/0040735 | A1* | 2/2006 | Baerlocher | 463/26 |
| 2006/0046825 | A1 | 3/2006 | Bozeman et al. | |

OTHER PUBLICATIONS

Quickfire Lotto http://original.getminted.com/spg/howtoplay/htp_quickfire_lotto.html.

Lottery mathematics http://en.wikipedia.org/wiki/Lottery_mathematics.

* cited by examiner

| | | | | | |
|---|---|---|---|---|---|
| **1** | **Brazil** | **17** | **Greece** | **33** | **Russia** |
| 2 | France | 18 | Japan | 34 | Morocco |
| **3** | **Argentina** | **19** | **Uruguay** | **35** | **Norway** |
| 4 | Spain | 20 | Iran | 36 | Tunisia |
| **5** | **Czech Republic** | **21** | **Nigeria** | **37** | **Bulgaria** |
| 6 | Netherlands | 22 | Cameroon | 38 | Belgium |
| **7** | **United Kingdom** | **23** | **Croatia** | **39** | **Jordan** |
| 8 | Mexico | 24 | Korea | 40 | Slovenia |
| **9** | **Portugal** | **25** | **Paraguay** | **41** | **South Africa** |
| 10 | Italy | 26 | Poland | 42 | Côte d'Ivoire |
| **11** | **United States** | **27** | **Costa Rica** | **43** | **Finland** |
| 12 | Turkey | 28 | Colombia | 44 | Ecuador |
| **13** | **Denmark** | **29** | **Romania** | **45** | **Iraq** |
| 14 | Ireland | 30 | Saudi Arabia | 46 | Switzerland |
| **15** | **Sweden** | **31** | **Senegal** | **47** | **Mali** |
| 16 | Germany | 32 | Egypt | | |

Fig. 6

| FIFA Virtual World Cup 2006 – | | | 1st round |
|---|---|---|---|
| | | | June 2006 |
| Favorite team | **Korea** | | **1st selection** |
| FT | Brazil | 0 - 1 | Paraguay |
| FT | France | 0 - 1 | Poland |
| FT | Argentina | 2 - 1 | Costa Rica |
| FT | Spain | 2 - 0 | Colombia |
| FT | Czech Republic | 1 - 2 | Romania |
| FT | Netherlands | 2 - 1 | Saudi Arabia |
| FT | United Kingdom | 3 - 1 | Senegal |
| FT | Mexico | 0 - 2 | Egypt |
| FT | Portugal | 1 - 3 | Russia |
| FT | Belgium | 2 - 1 | Morocco |
| FT | United States | 1 - 0 | Norway |
| FT | Turkey | 2 - 1 | Tunisia |
| FT | Denmark | 1 - 0 | Bulgaria |
| FT | Ireland | 2 - 1 | Italy |
| FT | Sweden | 1 - 0 | Jordan |
| FT | Germany | 2 - 1 | Slovenia |
| FT | Greece | 1 - 0 | South Africa |
| FT | Japan | 2 - 1 | Côte D'Ivoire |
| FT | Uruguay | 0 - 1 | Finland |
| FT | Iran | 3 - 2 | Ecuador |
| FT | Nigeria | 1 - 2 | Iraq |
| FT | Cameroon | 2 - 5 | Switzerland |
| FT | Croatia | 2 - 0 | Mali |

Fig. 7a

| FIFA Virtual World Cup 2006 – 2nd round | | | |
|---|---|---|---|
| | | | June 2006 |
| Favorite teams | Korea **Germany** | | 1st selection **2nd selection** |
| FT | Argentina | 3 - 1 | Poland |
| FT | Spain | 4 - 1 | Iran |
| FT | United Kingdom | 2 - 1 | Egypt |
| FT | United States | 2 - 0 | Croatia |
| FT | Denmark | 1 - 2 | Paraguay |
| FT | Russia | 2 - 1 | Greece |
| FT | Turkey | 3 - 1 | Iraq |
| FT | Japan | 0 - 2 | Ireland |
| FT | Sweden | 1 - 3 | Netherlands |
| FT | Romania | 2 - 1 | Switzerland |
| FT | Belgium | 1 - 0 | Finland |

Fig. 7b

| **FIFA Virtual World Cup 2006** | | | 3rd round |
|---|---|---|---|
| | | | June 2006 |
| Favorite teams | Korea<br>Germany<br>**Russia** | | 1st selection<br>2nd selection<br>**3rd selection** |
| FT | United Kingdom | 0 - 1 | Paraguay |
| FT | Romania | 3 - 1 | Turkey |
| FT | United States | 2 - 1 | Netherlands |
| FT | Belgium | 2 - 0 | Spain |
| FT | Ireland | 3 - 2 | Argentina |

Fig. 7c

| FIFA Virtual World Cup – Final Round | | | | | | | | |
|---|---|---|---|---|---|---|---|---|
| | Teams | P | W | D | L | F | A | Pt |
| 1. | Ireland | 6 | 4 | 0 | 2 | 10 | 4 | 12 |
| 2. | United States | 6 | 3 | 1 | 2 | 6 | 3 | 10 |
| 3. | Rumania | 6 | 3 | 1 | 2 | 5 | 5 | 10 |
| 4. | Paraguay | 6 | 0 | 2 | 4 | 0 | 9 | 2 |

Fig. 8a

| | | | |
|---|---|---|---|
| FT | | Paraguay vs. Romania | 0 - 0 |
| FT | | United States vs. Ireland | 2 - 0 |
| FT | | Ireland vs. Paraguay | 2 - 0 |
| FT | | Romania vs. United States | 1 - 0 |
| FT | | United States vs. Paraguay | 0 - 0 |
| FT | | Ireland vs. Romania | 2 - 1 |
| FT | | Paraguay vs. United States | 0 - 1 |
| FT | | Romania vs. Ireland | 1 - 0 |
| FT | | Ireland vs. United States | 1 - 0 |
| FT | | Romania vs. Paraguay | 1 - 0 |
| FT | | Paraguay vs. Ireland | 0 - 5 |
| FT | | United States vs. Rumania | 3 - 1 |

| | | | |
|---|---|---|---|
| Favorite teams | Korea | | 1st selection |
| | Germany | | 2nd selection |
| | Russia | | 3rd selection |
| | **Belgium** | | **4th selection** |

Fig. 8b

| FIFA Virtual World Cup | | | |
|---|---|---|---|
| 1 | Belgium | 5 | Romania |
| 2 | Germany | 6 | Russia |
| 3 | Ireland | 7 | United States |
| 4 | Korea | + | Paraguay |

Fig. 8c

INTERACTIVE INTERNET LOTTERY

CROSS-REFERENCE TO RELATED APPLICATIONS

This application claims priority under 35USC §119(e) of U.S. provisional patent application 60/782,618, entitled "Interactive Internet Lottery" that was filed Mar. 16, 2006, the specification of which being hereby incorporated by reference.

BACKGROUND OF THE INVENTION

1) Field of the Invention

The invention relates to a method and apparatus for conducting a lottery game. More particularly, the invention relates to a method and apparatus for selecting a combination that will constitute a lottery ticket for a subsequent lottery draw.

2) Description of the Prior Art

In a 6/49 lottery game, six numbers are drawn from a set of forty-nine and the owner of a ticket that has the six numbers is a jackpot winner. To play a 6/49 lottery, a player has previously purchased a lottery ticket. The six numbers on the lottery ticket are either selected by the player or randomly selected by the distributing machine. In a 6/49 lottery, the order in which the numbers are drawn is not relevant. The odds of winning the jackpot in a lottery are defined by the following statistic equation:

$$\binom{n}{k} = \frac{n!}{k!(n-k)!}$$

where k numbers are drawn from a range of n numbers. In the case of a 6/49, the odds of winning the jackpot are 1 in 13,983,816. Some lower value prizes are typically granted to owners of tickets having a part of the winning combination. A bonus number is typically also drawn. When a ticket matches some of the numbers of the winning combination, the prize granted will be increased if the ticket also matches the bonus number. Since there may be more than one ticket bearing the same combination, should more than one player win the jackpot, it is split among them.

Online lotteries allow a user to buy tickets and select a numeral combination online. As in conventional lotteries, the winning combination is subsequently drawn and virtual tickets matching the winning combination are jackpot winning tickets.

Sports pool games allow sports fans to wager, either online or using conventional tickets, on real life sports such as, for instance, hockey playoffs or a soccer challenge.

Some lottery organizations also offer instant internet lottery games. To play an instant internet lottery game, the player needs to purchase a ticket bearing an access code. By playing the internet game, the player discovers if the purchased ticket is a winning ticket. The ticket is already a winning or a losing ticket when purchased. The purpose of the internet game is only to check the ticket in an entertaining manner. A winning ticket must be confirmed by means of its verification number. In order to claim a prize, the player must present the ticket to a ticket retailer.

SUMMARY OF THE INVENTION

It is an object of the present invention to provide a lottery game involving a computer-implemented interactive game to provide a ticket having a combination at least partly selected using an outcome of the interactive game.

In accordance with a first broad aspect of the present invention, there is provided a method for providing a ticket having a ticket combination to participate in a lottery draw. The method comprises : defining a list of predetermined elements, the ticket combination to be a subset of the elements of the list; providing a computer-controlled interactive game to be played by at least a primary player, the game having an outcome; selecting elements of the ticket combination at least partly using the outcome of the computer-controlled interactive game; and providing the ticket having the ticket combination for participating in the lottery draw.

In accordance with a second broad aspect of the present invention, there is provided a system for providing a ticket having a ticket combination to participate in a lottery draw. The ticket combination is a subset of elements selected among a list of predetermined elements. The system comprises : a gaming module for at least a primary player to play a computer-controlled interactive game having an outcome; a ticket combination generator for determining the elements of the list to be included in the ticket combination at least partly using the outcome; and a ticket provider for providing a ticket having the ticket combination for use in the lottery draw.

BRIEF DESCRIPTION OF THE DRAWINGS

Further features and advantages of the present invention will become apparent from the following detailed description, taken in combination with the appended drawings, in which:

FIG. 6 is a table showing an exemplary list of elements, i.e. soccer teams, to be used in the lottery game of FIG. 5;

FIG. 7*a* is a table showing an exemplary result of a first round, in the lottery game of FIG. 5;

FIG. 7*b* is a table showing an exemplary result of a second round, in the lottery game of FIG. 5;

FIG. 7*c* is a table showing an exemplary result of a third round, in the lottery game of FIG. 5;

FIG. 8*a* is a table showing points accorded to teams in a final round, in the lottery game of FIG. 5;

FIG. 8*b* is a table showing an exemplary result of a final round, in the lottery game of FIG. 5; and FIG. 8*c* is a table showing an exemplary ticket combination generated in the lottery game of FIG. 5.

It will be noted that throughout the appended drawings, like features are identified by like reference numerals.

DETAILED DESCRIPTION OF THE INVENTION

In a lottery game, participants purchase tickets bearing a ticket combination 18 of elements selected among a list 14 of elements 16. FIG. 1 illustrates combinations of elements used in a lottery game. The elements 16 may be numerals, symbols, words or letters, as illustrated in FIG. 1. Any other category of elements 16 could alternatively be used. As an example, the elements 16 could be football teams, car racing drivers, names of competitors in a challenge or playing cards. The elements of the combination of the purchased ticket are selected by the participant, randomly or using the outcome of a computer-controlled interactive game. Every week, every month, several times in a year, at a single predetermined time or using any other timeframe, a winning combination 20 is randomly selected among the same list 14 of elements 16. A participant having a ticket bearing the winning combination 20 is a jackpot winner. Some lower value prizes may also be granted to participants having a part of the winning combination. Since there may be more than one ticket bearing the same combination, should more than one player win the jackpot, it may be split among them, or the jackpot may be multiplied such that each jackpot winner wins a predetermined jackpot. Should no ticket bear the winning combination, the jackpot may be kept for a next draw, or the jackpot may be allotted to participants having the largest part of the winning combination. Known practices for the allocation of winnings in lottery games may be used with the method of the present invention.

Figure 1A:
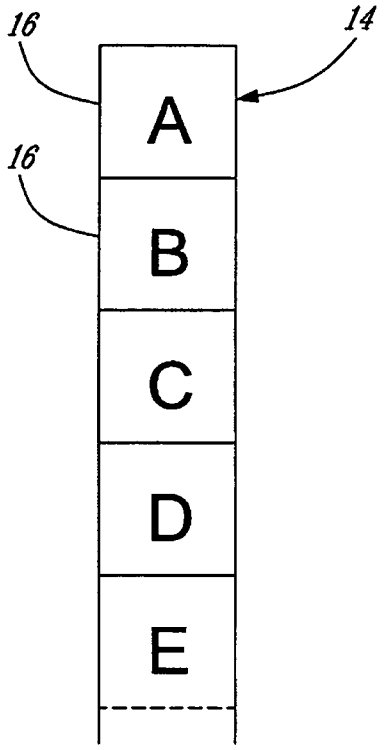
FIG. 1A-1E are schematic views of a list of elements and of combinations of elements used in a lottery game.
Figure 1B:
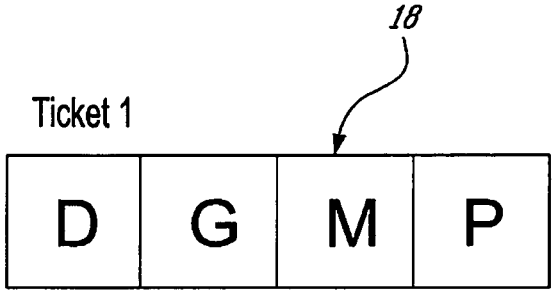
Figure 1C:
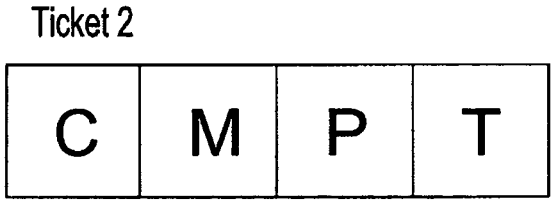
Figure 1D:
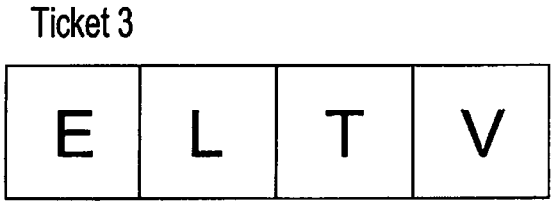
Figure 1E:
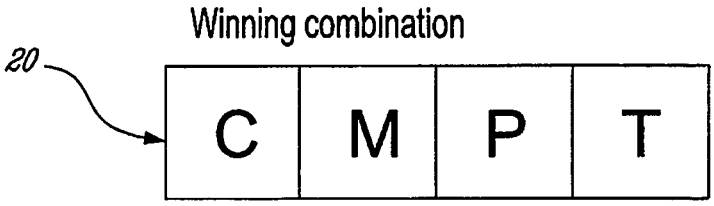
Figure 2:
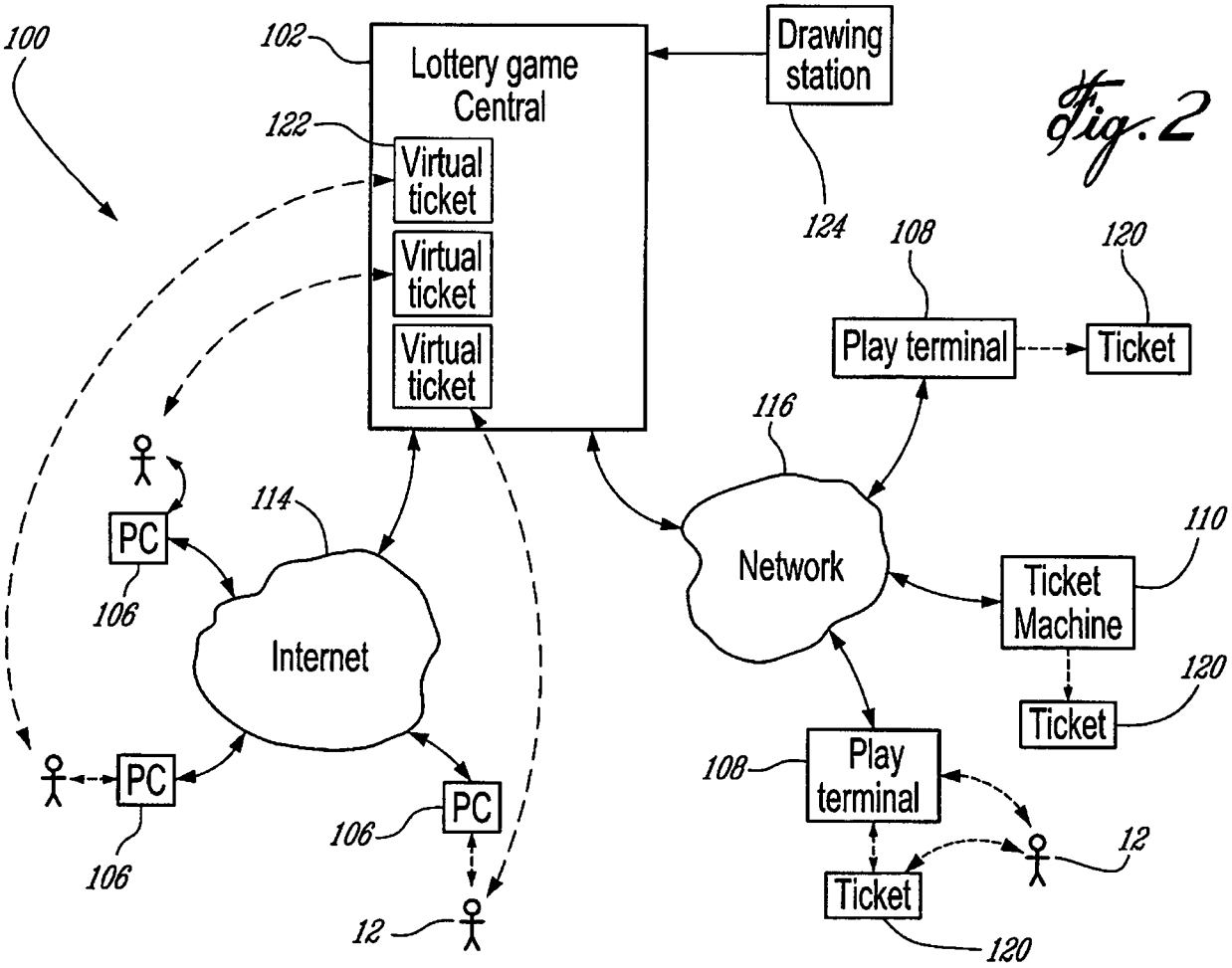
FIG. 2 is a schematic view of a lottery system according to one embodiment of the invention.

FIG. 2 shows a lottery system 100 using the outcome of a computer-controlled interactive game for selecting ticket combinations. The lottery system 100 comprises a lottery game central 102 connected to interfaces for participants to purchase lottery tickets, such as personal computers (PC) 106, play terminals 108 and ticket machines 110, using computer connections such as the Internet 114 or a computer network 116. The lottery system 100 allows players 12 to purchase virtual tickets 122 at home using their PC 106 connected to the Internet 114 or printed tickets using a play terminal 108 or a ticket machine 110 accessible at ticket retailers. Alternatively, in one embodiment, only virtual tickets 122 could be available, only printed tickets 120 could be available using play terminals 108 or ticket machines 110, or any other combination of means to purchase printed or virtual tickets 120, 122 could be used.

Using a PC 106, a player 12 connects to the lottery game central 102 through the Internet 114 to purchase a virtual ticket 122 with a selected ticket combination. The player selects a ticket combination by playing a computer-controlled game. The computer-controlled game may be provided as a software previously installed on the PC or it may be remotely accessible from a web server, located at the lottery game central 102 for example. The outcome of the computer-controlled game, such as a video game, is used in determining at least a portion of the ticket combination. The player may choose some of the elements to be included in the ticket combination throughout the computer-controlled game. The player may also have the option of selecting a ticket combination without the use of the computer-controlled game.

It is noted that a mobile phone, a pocket PC or a car on-board PC could also be used by the player to connect to the lottery game central 102 using the internet, to select a ticket combination by playing the computer-controlled game and to purchase a virtual ticket having the selected ticket combination.

The play terminal 108 is a user interface provided at any public location and connected to the lottery game central 102, thereby allowing a player 12 to purchase a printed ticket 120 and select the ticket combination by playing the computer-controlled game. The play terminal 108 may provide a virtual ticket 122 or a printed ticket 120.

Other participants to the lottery game can purchase printed tickets 120 using a ticket machine 110 provided at a ticket retailer or any public location. A ticket machine 110 does not allow a participant to play the computer-controlled game but the participant can purchase a printed ticket 120 bearing a randomly (or pseudo-randomly) selected ticket combination. The ticket machine 110 is operated either by the participant or by a retailer employee. Alternatively, the ticket machine 110 can provide virtual tickets 122 instead of printed tickets 120 and can associate the virtual tickets 122 to the participants using identification information. Additionally, the ticket machine 110 can allow the participant to choose a ticket combination.

It should be understood that a printed ticket 120 or a virtual ticket 122 could bear more than one different ticket combination. For example, a ticket having two ticket combinations is equivalent to two separate tickets each having one ticket combination.

At regular intervals, the ticket purchase period is interrupted for a short period of time and a drawing station 124 randomly selects a winning combination. The drawing station 124 may be part of the lottery game central 102 or may be a separate entity that is associated to other lottery systems in other jurisdictions. For example, there may be similar lottery systems 100 in different countries around the world but all the lottery systems 100 may be associated to the same main drawing station 124 and use the same winning combination to determine the winners in their own lottery system 100. In addition to functioning like standard lotteries where balls each bearing a number are drawn out of a rotating drum, the drawing station 124 can randomly select the winning combination using a software. For example, the drawing station 124 emulates the computer-controlled game and thus randomly selects the winning combination.

Figure 3:
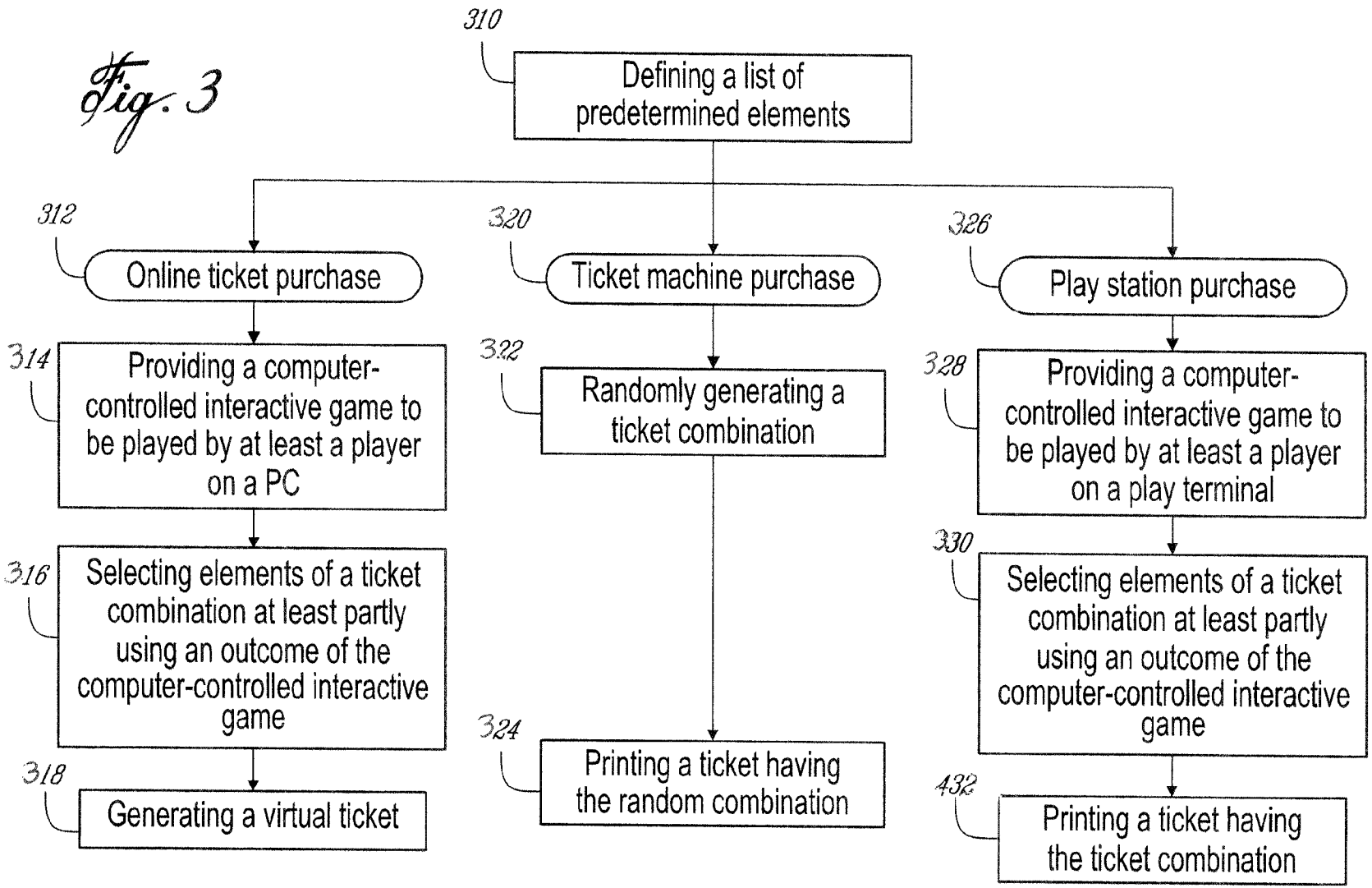
FIG. 3 is a flow chart illustrating a method for providing a lottery ticket according to the lottery system of FIG. 2.

FIG. 3 illustrates a method for providing a lottery ticket having a ticket combination and for use in a lottery game according to the lottery system 100 of FIG. 2. First, in 310, a list of predetermined elements is defined. A predetermined number of elements is to be selected among the list of elements to provide the ticket combination. The method allows a participant three options to purchase a ticket. In a first option 312, the participant buys a ticket online. In a second option 320, he/she buys a ticket using a ticket machine. In a third option 326, he/she buys a ticket using a play terminal.

According to the first option 312, in step 314, a computer-controlled interactive game to be played by at least one player on a PC, is provided. In step 316, elements of a ticket combination are determined at least partly using an outcome of the computer-controlled interactive game. For instance, the computer-controlled interactive game is a Virtual Football Challenge Cup game. A player plays on behalf of one of the football teams and the other teams are controlled by the computer. The teams compete in a world cup type tournament and the finalist teams constitute the ticket combination. The elements of the ticket combination are thus selected among the list of football teams in the Virtual Football Challenge Cup game. In step 318, a virtual ticket is generated by registering the generated ticket combination in association with the player in a lottery game central database, According to the second option 320, i.e. the ticket machine purchase, in step 322, a ticket combination is randomly generated by the ticket machine. In step 324, a ticket bearing the combination is printed. The participant owns the printed ticket.

According to the third option 326, i.e. the play terminal purchase, in step 328, a computer-controlled interactive game to be played by at least one player on a play terminal, is provided. The game is the same as the one played by the participants using the online ticket purchase 312, e.g. the Virtual Football Challenge Cup game. In step 330, elements of a ticket combination are selected at least partly using an outcome of the computer-controlled interactive game. The computer-controlled interactive game is played by a player on the play terminal. In step 432, a ticket bearing the combination is printed. The participant owns the printed ticket.

Figure 4:
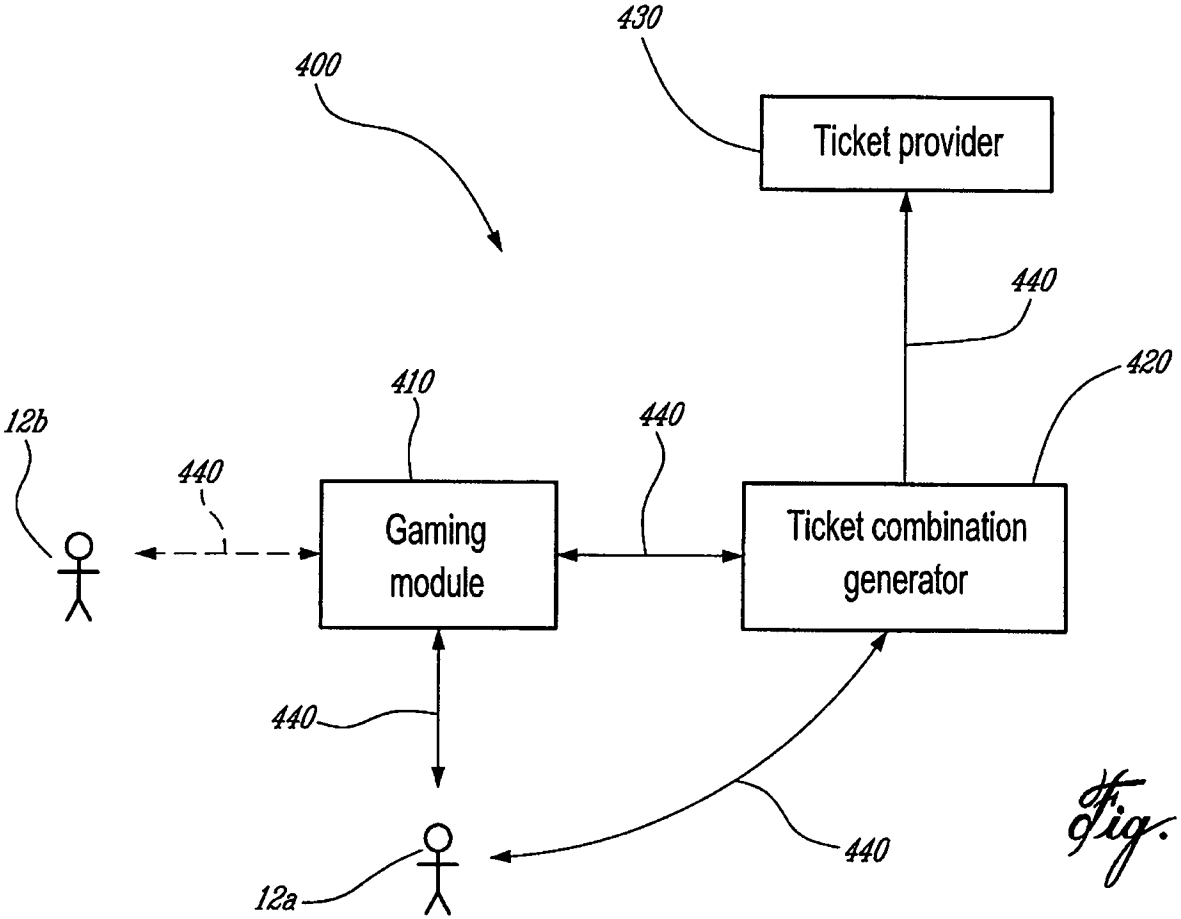
FIG. 4 is a block diagram illustrating a system for providing a lottery ticket having a ticket combination of elements selected using the outcome of a computer-controlled interactive game.

FIG. 4 illustrates the main software components of a system 400 for providing a lottery ticket having a ticket combination of elements selected using the outcome of a computer-controlled interactive game. The computer-controlled game is made available for the player 12a to play using a gaming module 410 which is a software module that can either be previously installed on the interface device, e.g. the PC 106 (see FIG. 2), the play terminal 108 (see FIG. 2), a mobile phone, a pocket PC or a car on-board PC, or on a web server remotely accessible through the internet using any of exampled interface devices, and provided, for example, at the lottery game central 102 (see FIG. 2). In any case, the gaming module 410 communicates the outcome of the game to a ticket combination generator 420 which determines the elements to be included in the ticket combination at least partly using the outcome of the game. The ticket combination generator 420 is also a software module that can either be previously installed on the interface device or on a web server remotely accessible through the internet. However, the ticket combination generator 420 and the gaming module may or may not run using the same computer and they may communicate directly or though a computer network such as the internet.

In the process of generating the ticket combination, the gaming module 410 and the ticket combination generator 420 may exchange information at more than one time. For example, if the elements of the list of elements are hockey teams, the ticket combination generator 420 first provides the gaming module 410 with the names of two teams that are to compete, the player 12*a* to be playing on behalf of one of the two teams. The ticket combination generator 420 may comprise a user input for the player 12*a* to input a selection of the team he/she will be playing for. In a first round, a first match is played and, for example, the losing team is eliminated and is thereby excluded from the ticket combination. The result of other matches involving the other teams can be randomly determined, and all losing teams are eliminated and excluded from the ticket combination. Among the remaining teams, the ticket combination generator 420 provides the gaming module 410 with the names of two of the remaining teams that are to compete, the player 12*a* to be playing on behalf of one of the two teams. This process is repeated until the number of remaining teams corresponds to the number of elements to be included in the ticket combination. The ticket combination is thus provided.

In the process of generating the ticket combination, some elements of the ticket combination may also be selected by the player and inputted to the ticket combination generator 420 using the user input.

The resulting ticket combination is then provided to a ticket provider 430 which receives the payment of the lottery ticket and provides a ticket having the generated ticket combination, to the player 12*a*. The ticket provider 430 is located at the lottery game central 102 (see FIG. 2) remotely accessible through the internet.

Depending on the physical location of each of the modules 410, 420, 430, each communication channel 440 can either be a direct software connection or a computer network connection.

It is noted that more than one player may participate in the computer-controlled interactive game. For example, the primary player 12*a* may host the gaming module 410 on its PC while a secondary player 12*b* remotely connects, typically through the Internet, to the PC of the primary player using a second PC. Each player then plays on behalf of a team, the teams competing against each other. A ticket combination is then generated by the ticket combination generator 420 as a function of the outcome of the game. Depending on the scheme used to generate the combination, only one player may have a combination or both players may have the same or different combinations. The ticket combination generator 420 may provide a ticket to one or both players or separate ticket combination generators 420 may be provided for each player.

Figure 5:
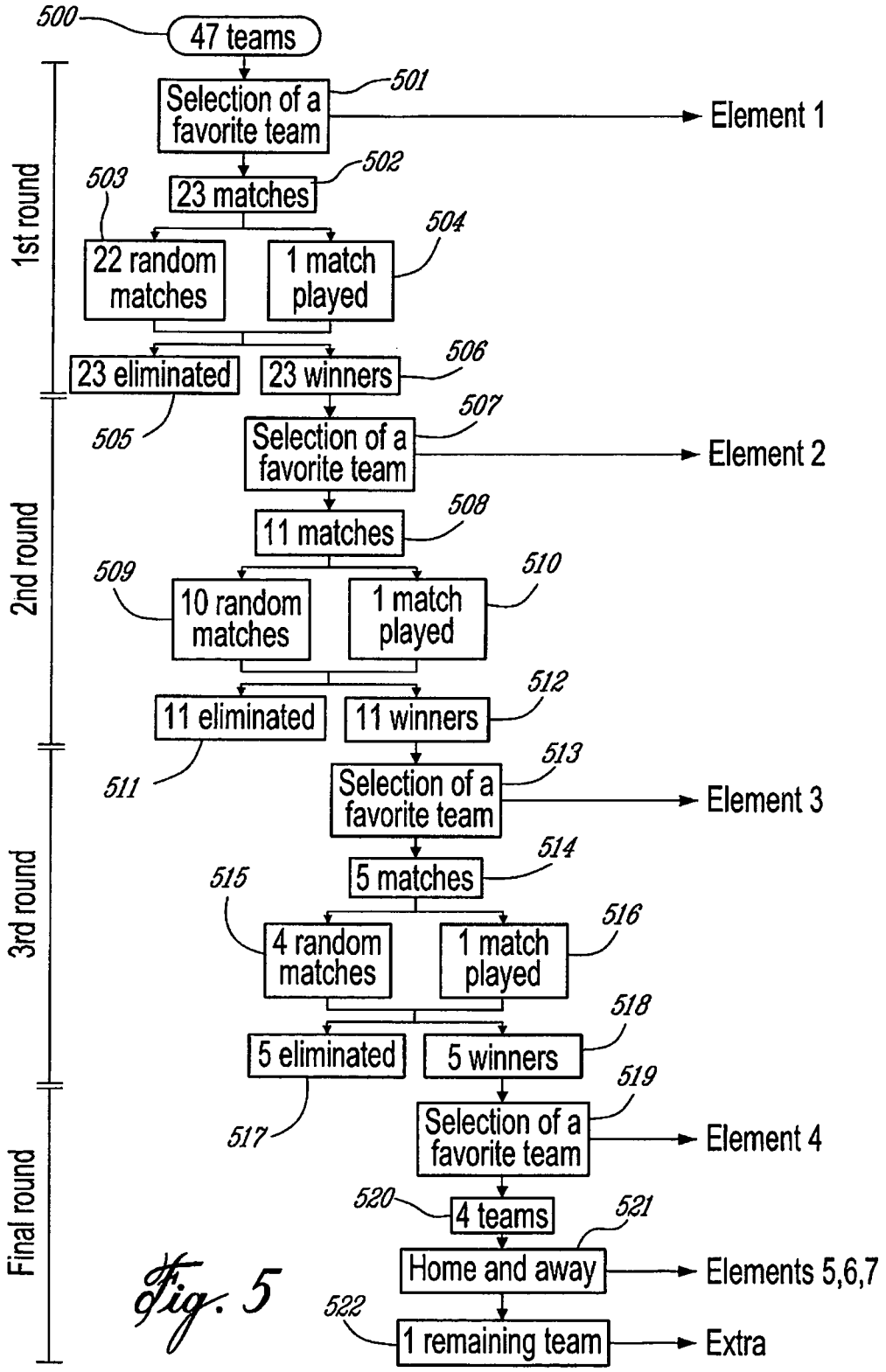
FIG. 5 is a flow chart illustrating a generation of a ticket combination of elements in a lottery game wherein the computer-controlled interactive game is a sporting event.

According to one embodiment of the invention, the computer-controlled interactive game used in the lottery game is a Virtual Football Challenge Cup game. FIG. 5 illustrates one embodiment for the generation of a ticket combination in a Virtual Football Challenge Cup lottery game. The list of elements used to generate the ticket combination is a list of forty-seven football teams. An exemplary list of football teams is given in FIG. 6. The Virtual Football Challenge Cup game begins with forty-seven teams 500. In a first round, the player selects a first favorite team 501, e.g. Korea, among the list of football teams. This selection becomes a first element (Element 1) of the ticket combination. The forty-six remaining teams compete in twenty-three simultaneous matches 502. The player competes on behalf of one of the forty-six teams 504 and the computer plays for the team competing against the player's team. The player may choose which team he is playing for. The result of each of the twenty-two other matches is randomly established 503. Alternatively, the player may choose to let the computer randomly establish the result of all the matches, or to participate as one of the opponents in each of the twenty-two other matches. In this case, the matches would be played successively instead of simultaneously. The twenty-three teams that lose their first match are eliminated 505. An exemplary result of a first round is shown in FIG. 7*a*. In a second round, among the twenty-three winners of the first round 506, the player selects a second favorite team 507, e.g. Germany, to be included in the ticket combination as Element 2. The twenty-two remaining teams compete in eleven simultaneous (or successive) matches 508. The player competes on behalf of one (or half) of the twenty-two teams 510. The result of each of the ten other matches is randomly established 509. The eleven teams that lose their second match are eliminated 511. FIG. 7*b* shows an exemplary result of a second round. In a third round, among the eleven winners of the second round 512, the player selects a third favorite team 513, e.g. Russia, to be included in the ticket combination, i.e. Element 3. The ten remaining teams compete in five matches 514. The player competes on behalf of one of the ten teams 516 and the results of the other matches are randomly established 515. The five teams that lose their third match are eliminated 517. FIG. 7*c* shows an exemplary result of a third round. Lastly, In a final round, among the five winners of the third round 518, the player selects a fourth favorite team, e.g. Belgium, to be included in the ticket combination 519, i.e. Element 4. The four remaining teams 520 compete in a home and away challenge between each other 521. The three teams that cumulate the highest score in this challenge are included in the ticket combination as Elements 5, 6 and 7, for a combination of seven teams out of forty-seven. The forth team 522 is the bonus, Extra, element of the ticket.

As shown in FIG. 8*a* and FIG. 8*b*, the scores in the final round are determined according to the number of victories, defeats and draws in the home and away challenge. A victory gives three points, a draw gives one point and a defeat gives no points.

Alternatively, in order to reduce the number of matches in the last round, the home and away challenge of the last round could be replaced by a home or away challenge.

During the first, second and third rounds, following a tied result at the end of one random match, the winner is determined using penalty shootouts. The results of the penalty shootouts are, as the results of the matches, randomly determined. Alternatively, the player could elect, as he wishes, the winners of the penalty shootouts in the tied matches, or participate in the shoot-out to determine the winner.

It is noted that each time the player competes on behalf of a team, he may choose to compete against a second remote player competing on behalf of another team. According to the embodiment of FIG. 5, both players participate in the same Virtual Football Challenge Cup and only one ticket combination is generated as a result of the challenge. One or both players may purchase a ticket with the resulting combination and, accordingly, the two players may have a ticket with the same combination. If the combination happens to be a winning combination, the two players will be sharing the prize along with other ticket owners that may also have the winning combination.

According to this embodiment, an example allocation of prizes is shown in Table 1. The number of teams in a ticket combination that match the teams of the winning combination determines the prize granted to the ticket owner. The odds of winning are defined by combinatory statistics and depend on the number of elements in a combination and on the total number of elements in the list. In the case of a 7/47 lottery game, i.e. seven numbers are drawn from of a set of forty-seven, the odds of winning the jackpot are 1 in 62,891,500. In this specific example, one ticket bearing two ticket combinations is purchased for 2 Euros; seven ticket combinations are purchased for 5 Euros and fifteen for 10 Euros. The total share allotted to winners of one draw corresponds to a given percentage of sales. In this example, the sales reach 10 000 000 Euros and the total share distributed corresponds to 51% of the sales, for a total share of 5 100 000 Euros. The share allotted to each category of winners is calculated according to a percentage on the total share reduced by the total value of the prizes allocated to the 3/7 and 3/7+ categories. In each category of winners, the share is split among the winners.

TABLE 1

Allocation of the prices

| Nb of elements of the winning combination | Prize | % on total share | Odds of winning |
|---|---|---|---|
| 7/7 | 2,000,000€ | 55% | 1/62,891,500 |
| 6/7 | 14,280€ | 8% | 1/230,375 |
| 5/7 | 210€ | 7% | 1/3,840 |
| 4/7 | 42€ | 30% | 1/182 |
| 3/7 + bonus | 10€ | fixed | 1/196.5 |
| 3/7 | 2 free ticket combinations | fixed | 1/21.9 |

In alternative embodiments, the number of elements in the list of elements and in the combination may vary to provide different odds of winning. As an example, in a 6/49 lottery, the odds of winning the jackpot are 1 in 13,983,816.

According to one alternative embodiment, the computer-controlled interactive game used in the lottery game is a virtual hockey game. The list of elements used to generate the ticket combination is a list of sixty-four hockey teams. The ticket combination is generated using an elimination tournament. The grid of the elimination tournament is randomly defined. In each round, the player plays on behalf of one team and the other teams are computer-controlled, or another or other teams are controlled by another or other players. The elements of the ticket combination are the four teams reaching the semifinals. In an alternative embodiment, different odds of winning are obtained by adding in the ticket combination one of the teams eliminated before the semifinals, for a total of five teams.

In another embodiment, the computer-controlled interactive game is a car racing game. The elements of the ticket combination are selected among a list of car drivers. The player controls one of the car drivers and the others are computer controlled. The drivers of the fastest cars constitute the elements of the ticket combination which may or not include the car driver controlled by the player, depending on the performance of the player in the racing game.

In still another embodiment, the computer-controlled interactive game is a bingo game. Bingo cards are randomly distributed to a number of virtual predefined contestants and the player plays on behalf of one of the predefined contestants. The bingo numbers are randomly drawn and the winners of the bingo game constitute the elements of the ticket combination. For example, there may be N predefined contestants including "Bob". The player chooses to play on behalf of "Bob" and if "Bob" wins the bingo game, "Bob" becomes one element of the ticket combination.

It should be understood that the present invention is not defined on the basis of the type of game played to determine combinations of elements for lottery tickets. A purchaser of a ticket will actively participate in the selection of elements by playing a game that will determine a winner and a loser. The winner will either become an element in the ticket combination, or will be involved in a further determination of the elements of the ticket combination. The outcome of the game played by the purchaser of the ticket will not be predetermined, but rather will be influenced by the abilities or skills of the player participating in the game or by a random result.

The embodiments of the invention described above are intended to be exemplary only. The scope of the invention is therefore intended to be limited solely by the scope of the appended claims.

What is claimed is:

1. A computer-implemented method for providing a ticket having a ticket combination to participate in a lottery draw, said method comprising executing on a processor a set of instructions for:

receiving a list of predetermined elements, said ticket combination to be a subset of the elements of said list;

providing a computer-controlled interactive game to be played by at least a primary player, said game having a plurality of possible outcomes, the interactive game comprising at least two parties competing against each other in a sporting event, the primary player selecting one of the at least two parties and participating in the interactive game as the selected party;

selecting elements of said ticket combination at least partly non-randomly by selecting from the list of the predetermined elements at least one element that is associated with a winning party, an element associated with a losing party being excluded from the ticket combination, each one of the plurality of possible outcomes being associated with a different element selection of said ticket combination; and providing said ticket having said ticket combination for participating in said lottery draw, whereby said ticket combination is a participating combination in said lottery draw for a lottery draw participant.

2. The method as claimed in claim 1, wherein an outcome of the interactive game is a function of at least one action of said primary player in said game.

3. The method as claimed in claim 1, wherein a secondary player is to compete for a second one of said at least two parties, said first and said second ones of said parties to compete one against the other.

4. The method as claimed in claim 3, wherein an outcome of the interactive game is a function of a performance of said primary player in said game.

5. The method as claimed in claim 3, wherein said an outcome of the interactive game is a function of a performance of said primary and of said secondary player in said game.

6. The method as claimed in claim 1, wherein said elements of said list are parties to be competing in said computer-controlled interactive game.

7. The method as claimed in claim 1, wherein more than two parties are involved in the interactive game, and wherein all elements from said list associated with non-winning parties are excluded from said ticket combination.

8. The method as claimed in claim 6, wherein said selecting comprises said primary player choosing a party to be included in said ticket combination from said list, said game involving at least two parties remaining, said primary player to compete for one of said at least two parties to determine a loser, said loser to be excluded from said ticket combination.

* * * * *